US005952972A

United States Patent [19]

Ittipiboon et al.

[11] Patent Number: 5,952,972

[45] Date of Patent: Sep. 14, 1999

[54] BROADBAND NONHOMOGENEOUS MULTI-SEGMENTED DIELECTRIC RESONATOR ANTENNA SYSTEM

[75] Inventors: Apisak Ittipiboon, Kanata; Dave Roscoe, Dunrobin; Aldo Petosa, Nepean; Rajesh Mongia, Kitchener; Michel Cuhaci, Ottawa; Richard LaRose, Chelsea, all of Canada

[73] Assignee: Her Majesty the Queen In right of Canada as represented by the Minister of Industry through the Communications Research Centre, Ottawa, Canada

[21] Appl. No.: 08/824,722

[22] Filed: Mar. 26, 1997

[30] Foreign Application Priority Data

Mar. 9, 1996 [CA] Canada ..... 2173679

[51] Int. Cl.[6] ..... H01Q 3/02

[52] U.S. Cl. ..... 343/700 MS; 343/873

[58] Field of Search ..... 343/700 MS, 873; 333/21, 221.1, 202

[56] References Cited

U.S. PATENT DOCUMENTS 5,453,754 9/1995 Fray ..... 343/789

5,528,254 6/1996 Howng et al. ..... 343/873

OTHER PUBLICATIONS

Broadband Stacked Dielectric Resonator Antennas; Electronic Letters, Aug. 31, 1989, vol.25, No. 18, pp. 1232–1233.

Analysis of a Hemispherical Dielectric Resonator Antenna with an Airgap; Wong, Cheng, Chen Microwave and Guided Wave Letters, IEEE 1993, pp. 355–357.

Hemispherical Dielectric Resonator Antenna with a Concentric Conductor; Luk, Leung, Yung Antennas and Propagation, Newport Beach, CA 1995, pp. 730–733.

*Primary Examiner*—Don Wong
*Assistant Examiner*—Jennifer H. Malos
*Attorney, Agent, or Firm*—Neil Teitelbaum & Associates

[57] ABSTRACT

A dielectric resonator antenna system is disclosed wherein a dielectric material having a high dielectric constant is placed between a dielectric resonator antenna (DRA) and the antenna feed. Preferably the dielectric material having a high dielectric constant is either in the form of an insert within a cavity of the DRA or alternatively is in the form of a thin layer between the feed and the DRA for enhancing coupling therebetween. It is preferred that the high dielectric constant material be at least twice the value of the dielectric resonator antenna.

21 Claims, 12 Drawing Sheets

FIG. 2a
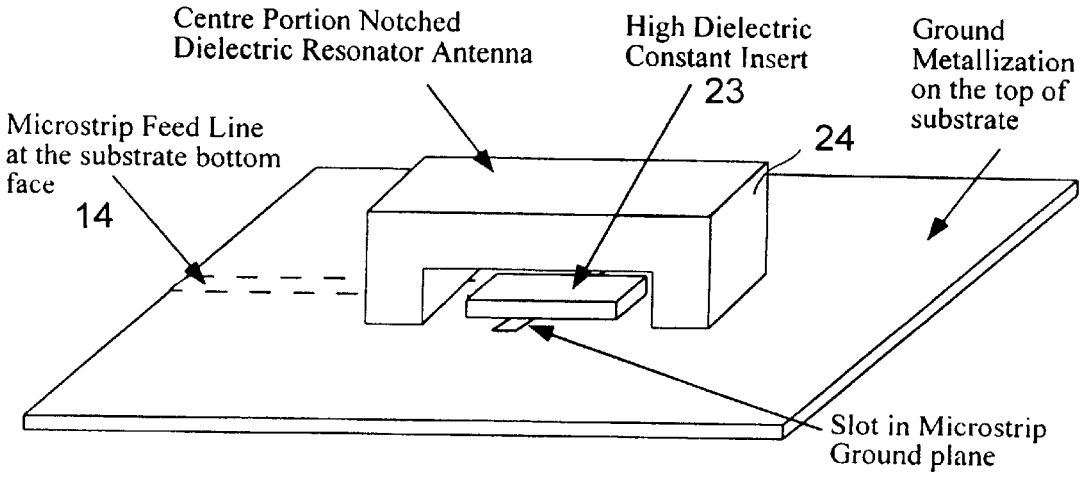
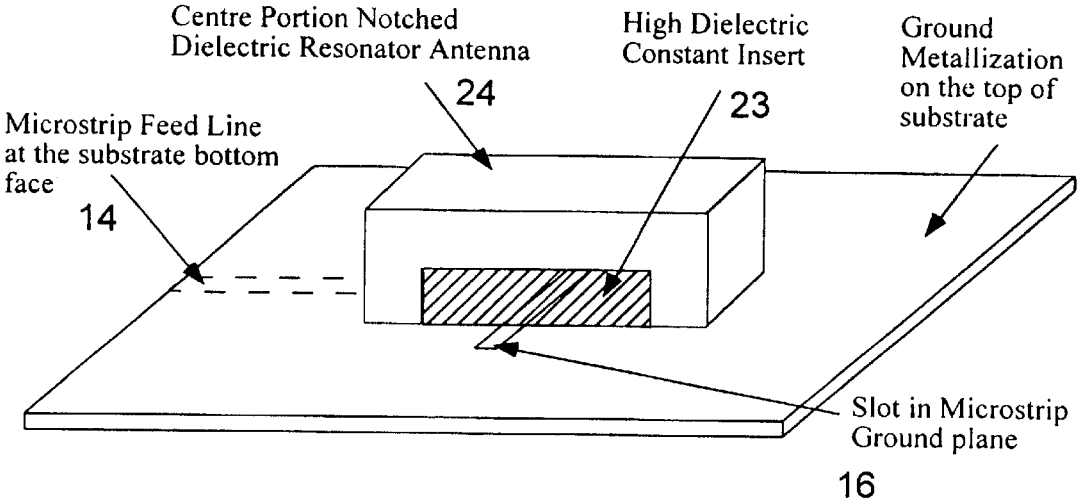
FIG. 2c

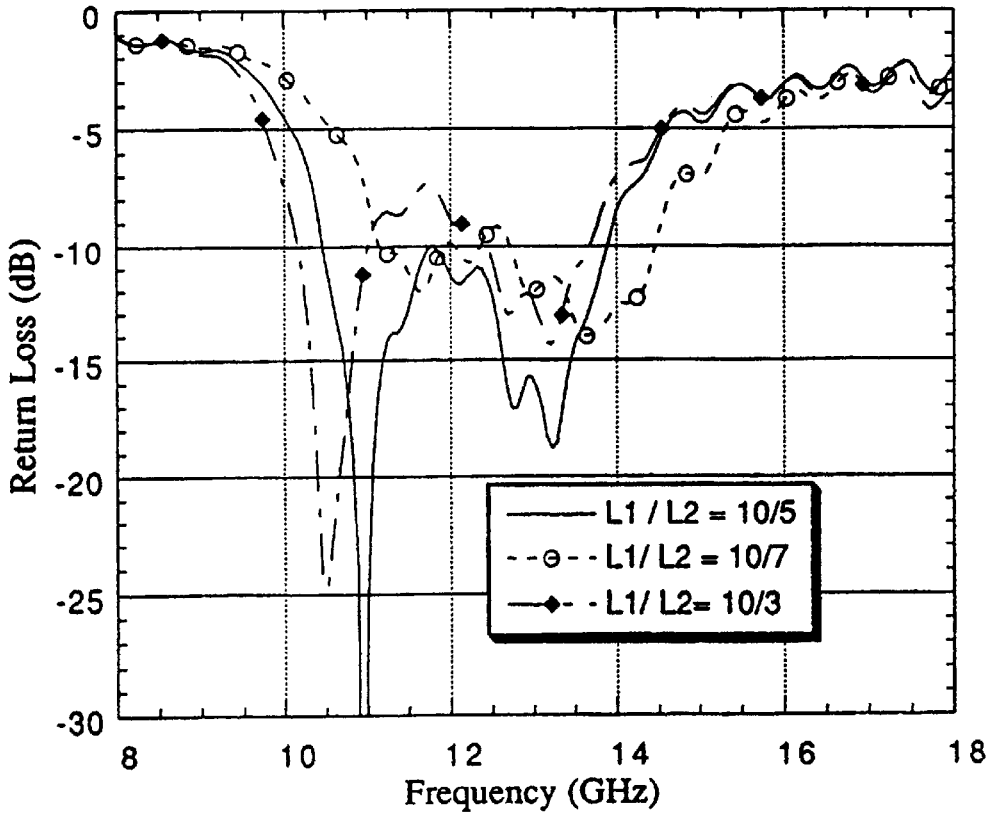
Figure 3 Return Loss of Rectangular Ring Dielectric Resonator Antennas

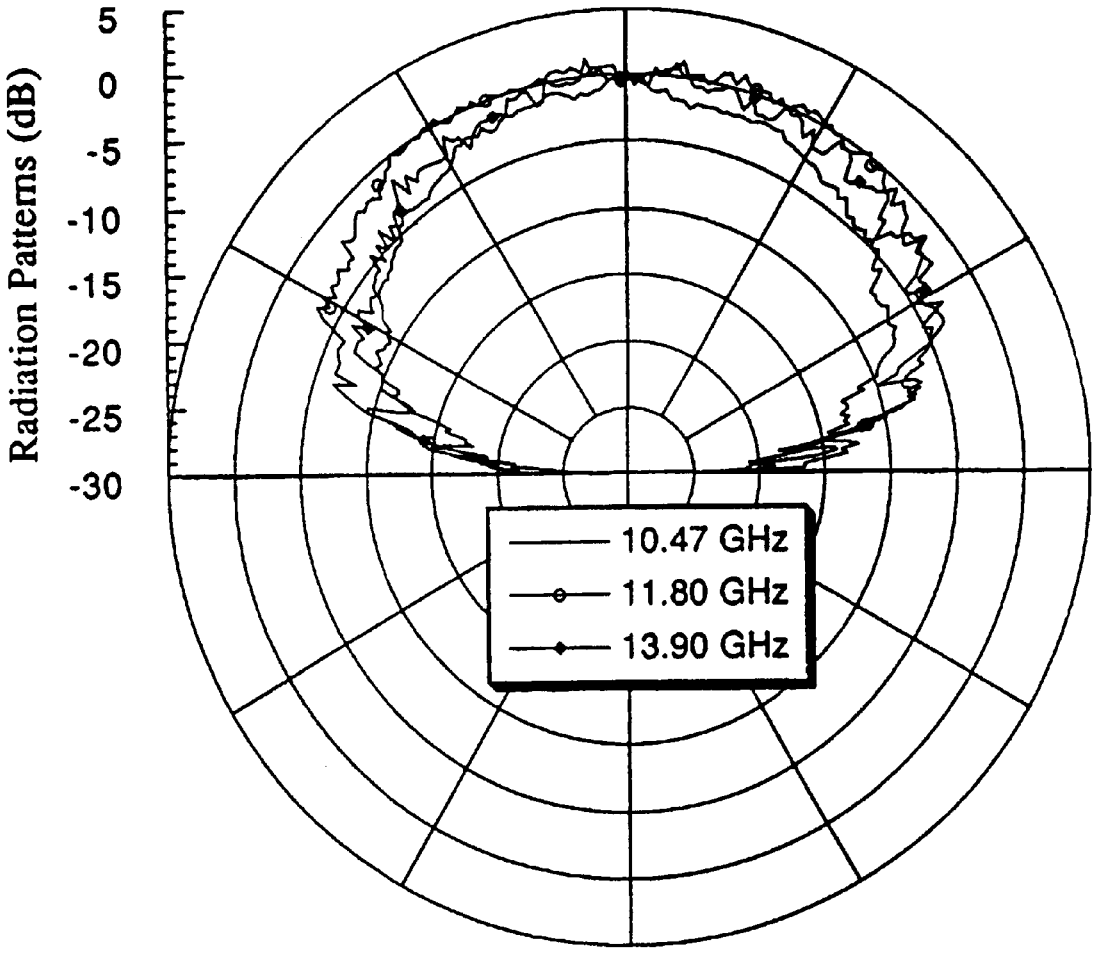
Figure 4a) H-Plane Pattern

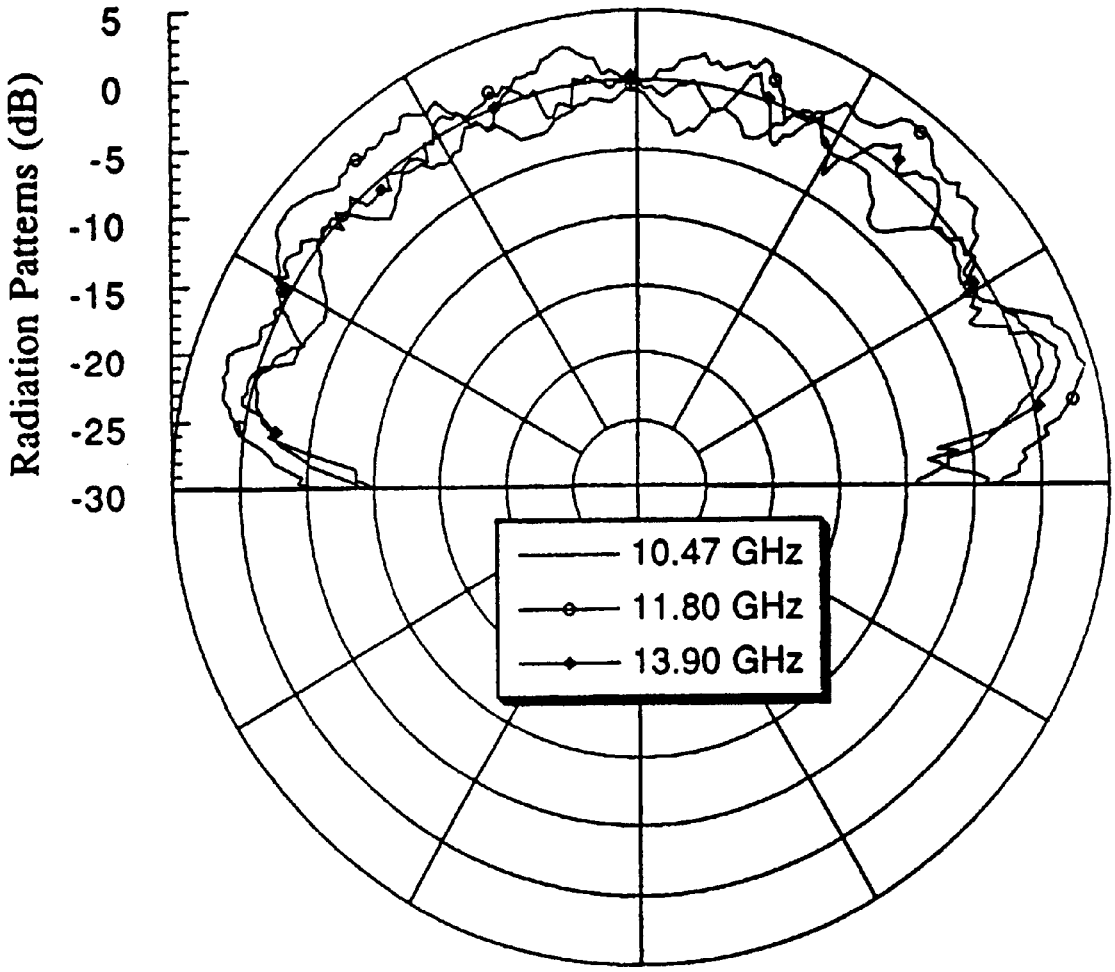
Figure 4 b) E-Plane Pattern

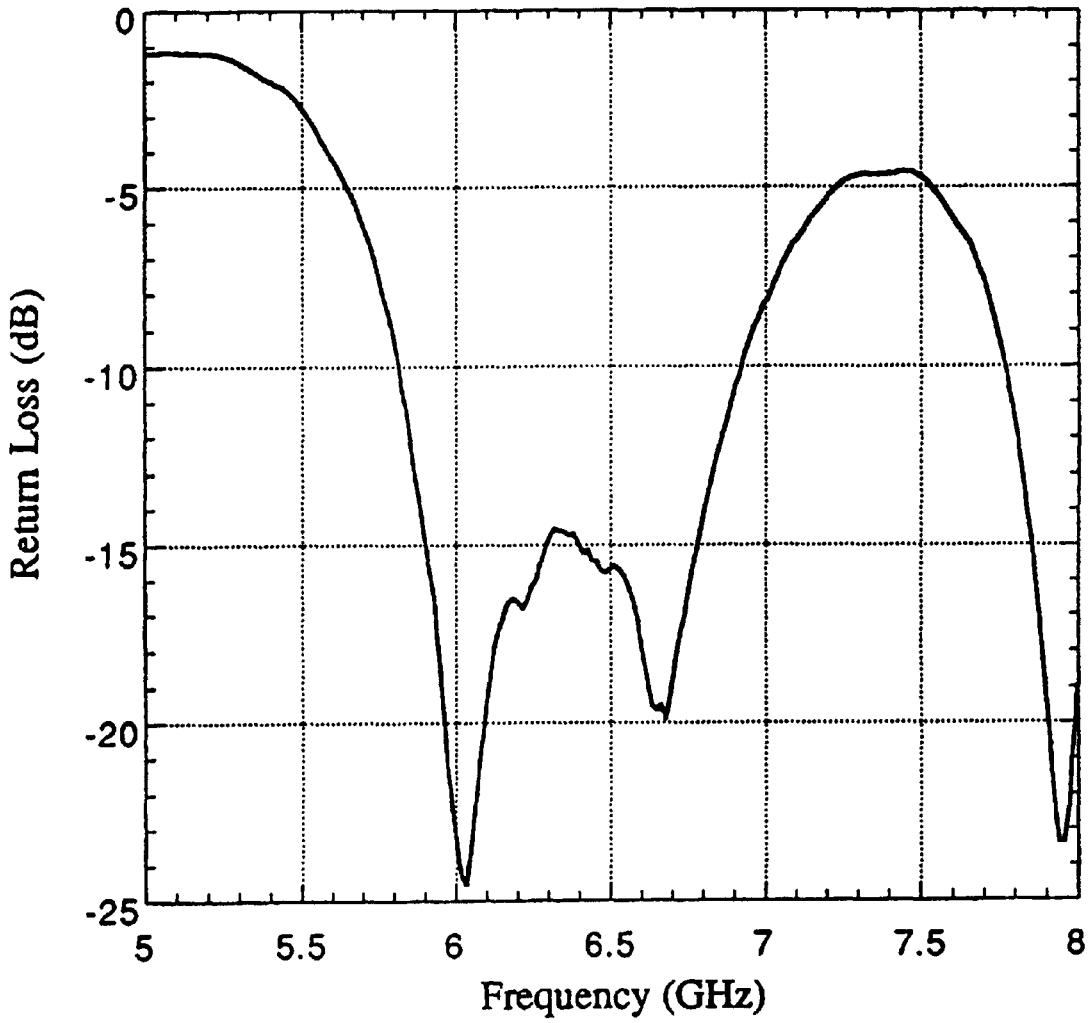
Figure 5 Measured return loss of MSDRA

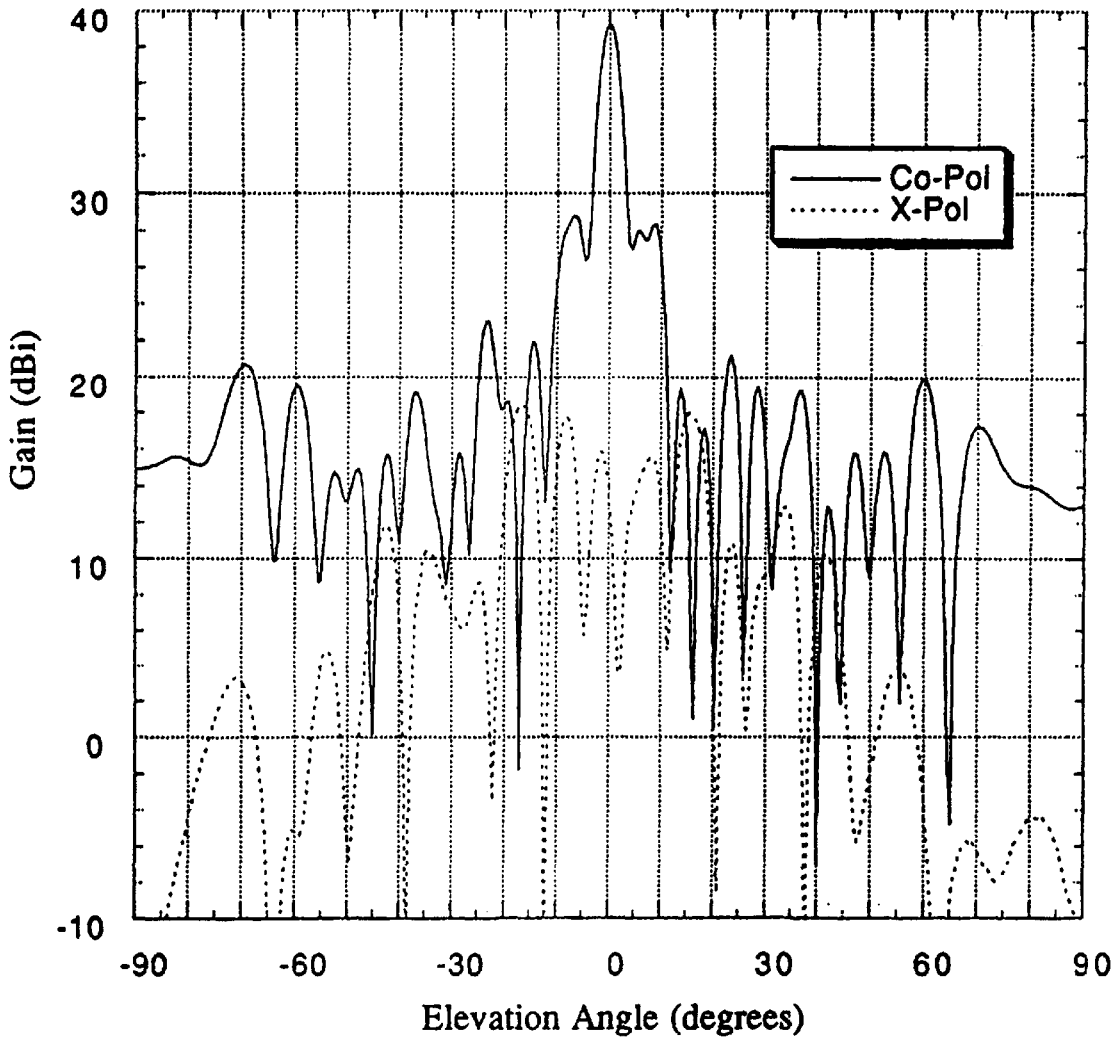
Figure 8 Measured elevation pattern of the 320 DRA active array

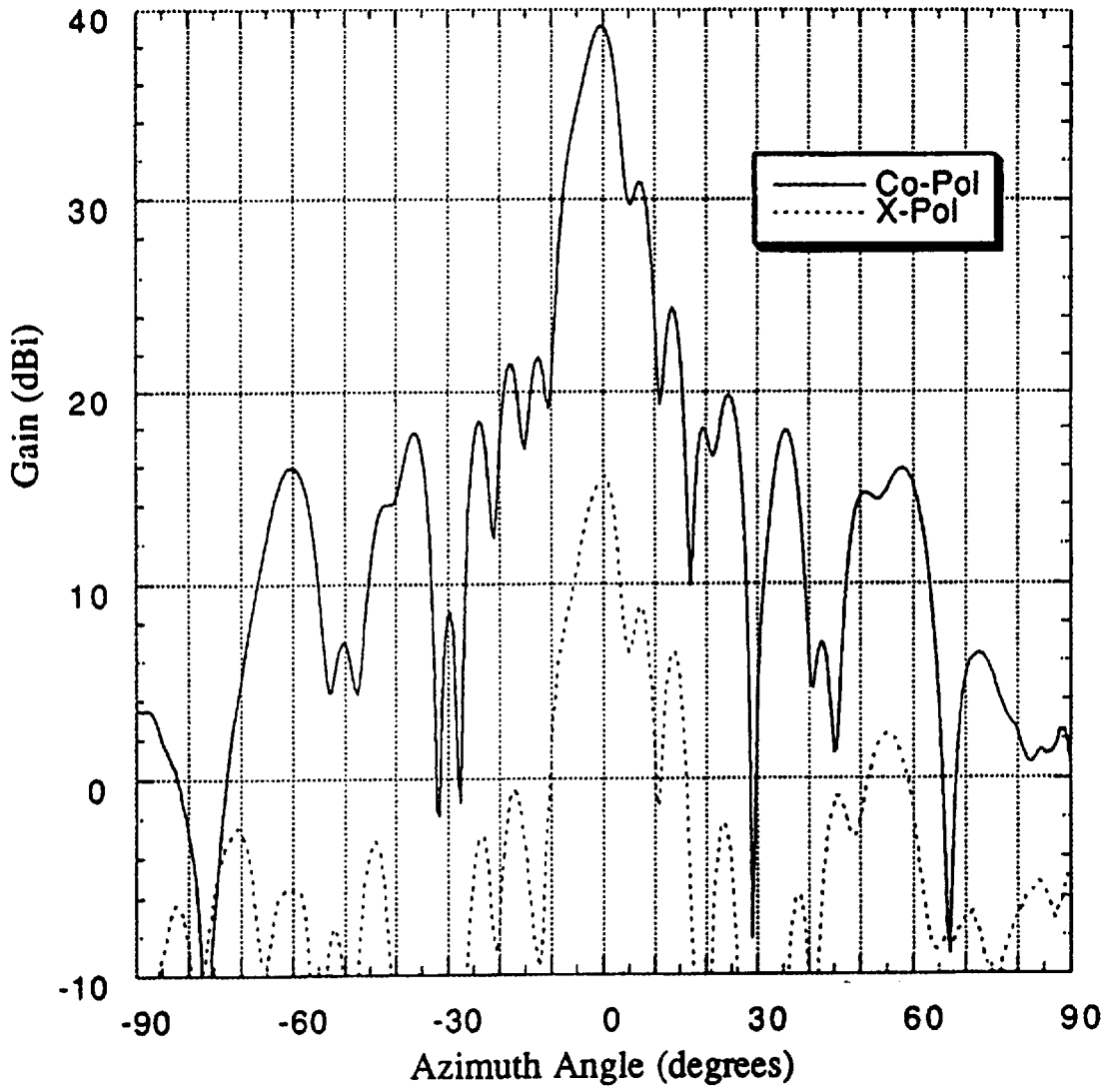
Figure 9 Measured azimuth pattern of the 320 DRA active array

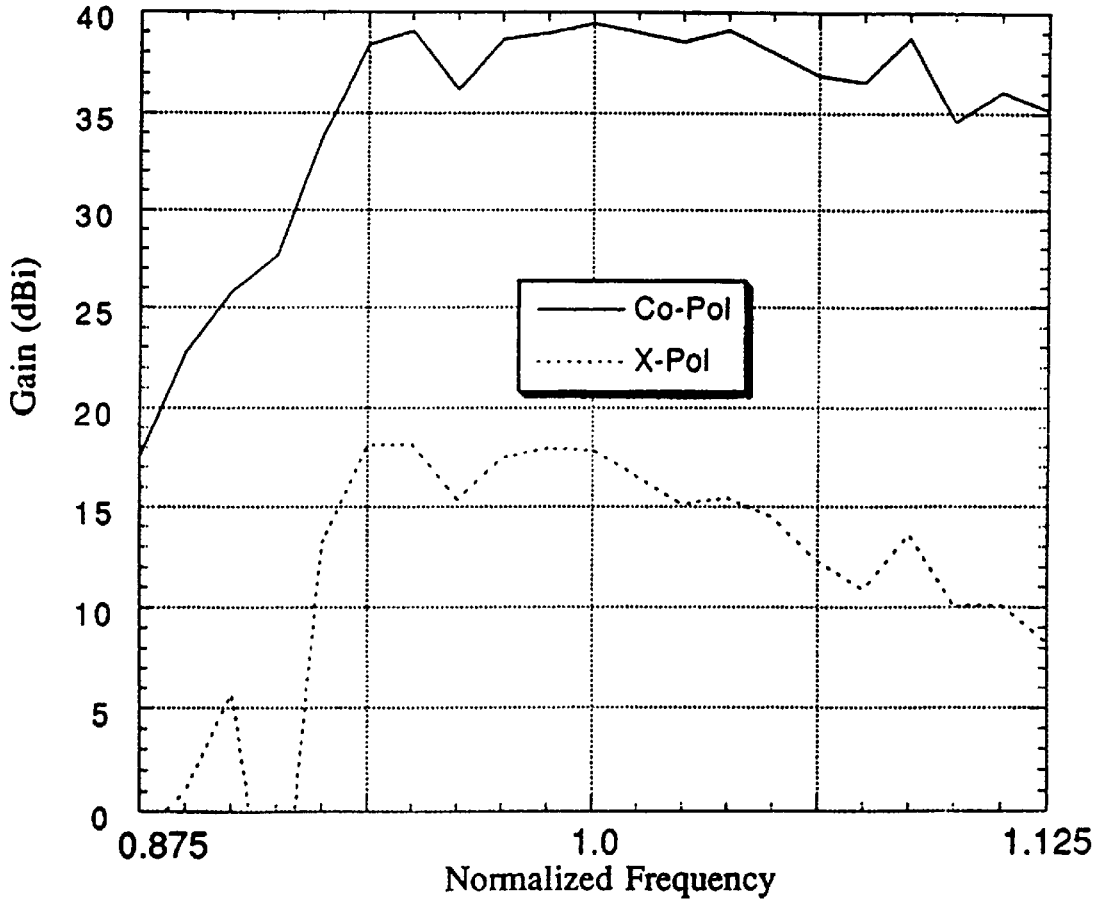
Figure 10 Active gain vs. normliazed frequency of 320 DRA antenna

BROADBAND NONHOMOGENEOUS MULTI-SEGMENTED DIELECTRIC RESONATOR ANTENNA SYSTEM

FIELD OF THE INVENTION

This invention relates generally to dielectric resonator antennas and more particularly to an antenna having a high dielectric material disposed between an antenna feed and a dielectric resonator.

BACKGROUND OF THE INVENTION

The rapid growth of information technology has been the main thrust for many advances in communication system developments such as satellite, wireless/mobile, and personal communications. Systems have been envisioned which will allow the communication from any time and place. In many of these systems the final point of contact is usually a wireless loop where antennas will play a crucial role. This puts a high demand on the antenna performance.

Ensuring efficient system operation requires an increased level of antenna integration into the system design right from the inception stage. The demand for high efficiency, compact size, low profile, and conformal construction is increasing. It is also very desirable for the antenna to be amenable to various arrangements of device integration as well as being capable of accommodating various operational requirements. Presently, these requirements are likely achieved by arrays of antenna candidates, which currently are mostly limited to printed structures. The most popular candidate is a microstrip antenna due to fabrication simplicity, low profile, and ease of integration with many devices. It is widely used for applications requiring frequencies ranging from L-Band to millimeter-waves. However, conventional microstrip antennas are known to suffer from a number of disadvantages such as narrow bandwidth, low efficiencies, and higher loss at millimeter-wave frequencies. Recently, a relatively new approach to building microwave antennas based on the use of a dielectric resonator (DR) as the radiating element has been proposed by S. A. Long, M. McAllister, and L. C. Shen, in a paper entitled 'The resonant cylindrical dielectric cavity antenna', *IEEE Trans. Antennas Propagat.,* Vol. AP-31, pp. 406–412,1983. Dielectric resonators (DRs) have been in use for a long time in microwave circuits mainly as energy storage devices. However, since DR boundaries are not conductors, there exists a 'loss' mechanism which forms the basis of their use as radiating elements. DRs have been found to overcome some disadvantages of microstrip antennas. They also possess the attractive features of microstrip patches but offer superior performance, particularly, in terms of bandwidth and radiation efficiency.

Dielectric Resonator Antennas (DRAs) are antennas fabricated entirely from low loss dielectric materials and are typically mounted on ground planes. Their radiation characteristics are a function of the mode of operation excited in the DRA. The mode is generally chosen based upon the operational requirement, however, the mode with the lowest Q is typically chosen. Various shapes of DRAs can also be used, including rectangular, disk, triangular, and cylindrical ring to obtain different radiation patterns suitable for a wide variety of applications. R. K. Mongia, A. Ittipiboon, Y. M. M. Antar, P. Bhartia, and M. Cuhaci, describe such an application in a paper entitled 'A half-split cylindrical dielectric resonator antenna using slot coupling', IEEE Microwave and Guided Wave Letters, Vol. 3, pp. 38–39, 1993. In another paper by A. Ittipiboon, R. K. Mongia, Y. M. M. Antar, P. Bhartia, and M. Cuhaci, entitled 'Aperture fed rectangular and triangular dielectric resonators for use as magnetic dipole antennas', Electron. Lett., Vol. 29, pp. 2001–2002, 1993 and yet another paper relating to DRAs is disclosed by A. Ittipiboon, D. Roscoe, R. Mongia, and M. Cuhaci, and is entitled, 'A circularly polarized dielectric guide antenna with a single slot feed', ibid., pp. 427–430.

Various feeding schemes can also be utilized to excite these modes. DRAs have been designed to produce either linear polarization with low cross-polarization levels or circular polarization with very good axial ratio performance over a broader bandwidth than obtainable from microstrip antennas. The reported performance of DRAs up to this point is impressive, however, in accordance with this invention is still further improved.

It is an object of the invention to provide an antenna with improved coupling efficiency and bandwidth by utilizing a high dielectric material between the ground plane and the DRA.

It is yet a further object of the invention to provide a novel method for increasing the coupling efficiency using a thin high dielectric constant strip.

STATEMENT OF THE INVENTION

In accordance with the invention a dielectric resonator antenna system is provided comprising a grounded substrate; a dielectric resonator having a dielectric constant k disposed a predetermined distance from the grounded substrate; feed means for transferring energy into and from said dielectric resonator; and a thin dielectric substrate having a thickness of less than approximately $\lambda/10$ and, having a dielectric constant of approximately 2k or greater, the thin dielectric substrate being disposed between the feed means and the dielectric resonator for enhancing coupling therebetween.

In accordance with the invention, a dielectric resonator antenna system is further provided comprising a plurality of resonator antenna elements each comprising: a grounded substrate; a dielectric resonator having a dielectric constant k disposed a predetermined distance from the grounded substrate; feed means for transferring energy into and from said dielectric resonator; and, a thin dielectric substrate having a thickness of less than $\lambda/10$ and, having a dielectric constant of approximately 2k or greater, the thin dielectric substrate being disposed between the feed means and the dielectric resonator for enhancing coupling therebetween.

In accordance with yet another aspect of the invention there is provided a dielectric resonator antenna system comprising: a grounded substrate; a dielectric resonator having a dielectric constant k disposed a predetermined distance from the grounded substrate; feed means for transferring energy into and from said dielectric resonator; and, a dielectric material having a dielectric constant of approximately 2k or greater disposed between the feed means and the dielectric resonator for enhancing coupling therebetween.

In yet another aspect of the invention there is provided, a dielectric resonator antenna system comprising an array of antenna elements, each element comprising: a grounded substrate; a dielectric resonator having a dielectric constant k disposed a predetermined distance from the grounded substrate; feed means for transferring energy into and from said dielectric resonator; and, a dielectric material having a dielectric constant of approximately 2k or greater disposed between the feed means and the dielectric resonator for enhancing coupling therebetween.

BRIEF DESCRIPTION OF THE DRAWINGS

Exemplary embodiments of the invention will now be described in conjunction with the drawings, in which:

FIG. 2*a* is an illustration of notched dielectric resonator antenna with a high dielectric insert fed by a slot;

FIG. 2*c* is an illustration of a dielectric resonator antenna having a high dielectric constant insert within a notched portion of the resonator;

FIG. 3 is a graph depicting return loss of 3 notched dielectric resonator antennas as a function of frequency;

FIGS. 4*a* and 4*b* shown measured radiation patterns for the notched DRA shown in FIG. *a*, with L1/L2=10/5;

FIG. 5 is a graph depicting measured return loss of DRA with high dielectric insert, fed by a 50 Ω microstrip line;

FIG. 8 is a graph depicting measured elevation pattern of a 320 element DRA array;

FIG. 9 is a graph depicting measured azimuth pattern of the 320 element DRA array; and, FIG. 10 is a graph of active gain versus normalized frequency for the 320 element DRA array.

DETAILED DESCRIPTION

The basic concept for obtaining a wider operational impedance bandwidth of a dielectric resonator antenna is to lower its Q-factor. The design approach is based on the studies reported by M. Verplanken and J. Van Bladel, in a paper entitled 'The magnetic-dipole resonances of ring resonators of very high permittivity', in *IEEE Trans. Microwave Theory Tech.,* Vol. MTT-27, pp. 328–333, 1979. Verplanken and Bladel showed that increasing the ratio of the inner to outer radii can reduce the Q-factor of dielectric ring resonators, thus lowering the amount of stored energy. It is expected that by removing the centre portion of the DRA, its bandwidth can be increased.

Figure 1A:
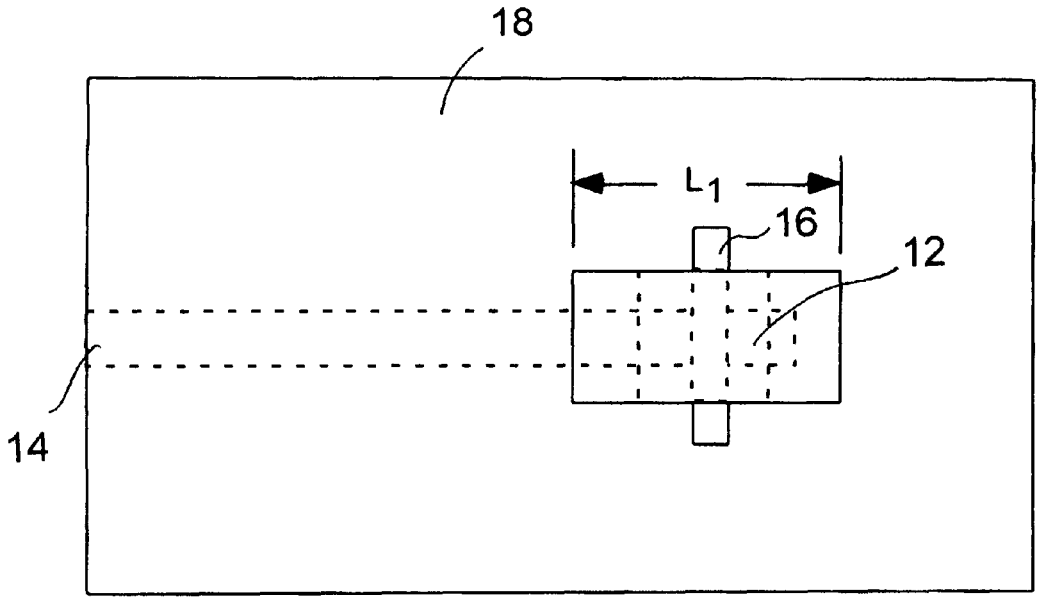
FIG. 1*a* is a top view of a notched dielectric resonator in accordance with the invention.
Figure 1B:
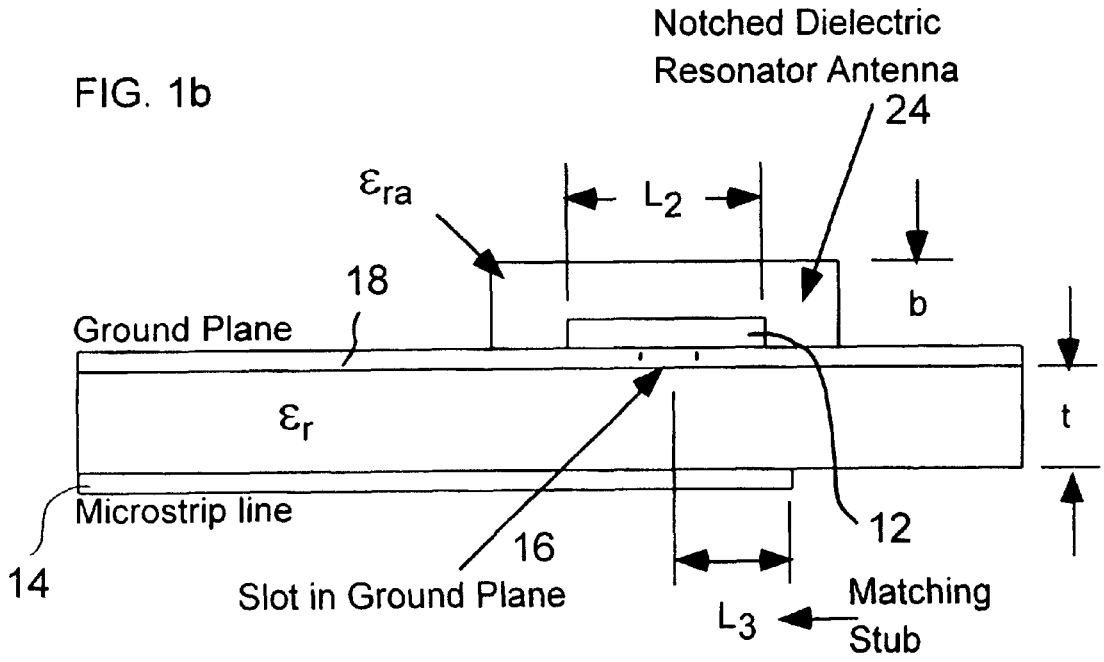
FIG. 1*b* is a side view of a notched dielectric resonator in accordance with the invention.

Referring now to FIGS. 1*a* and 1*b,* a slot-fed rectangular dielectric resonator antenna is shown with the centre portion removed, forming a rectangular notch 12. The antenna is fabricated from medium to high dielectric constant material disposed on a ground metalized substrate. The bottom layer of the substrate is a microstrip line feed layer 14. A signal is coupled to the antenna through a narrow rectangular slot 16, perpendicular to the feed line, in the common ground plane 18 between the antenna and the microstrip line 14.

Figure 2B:
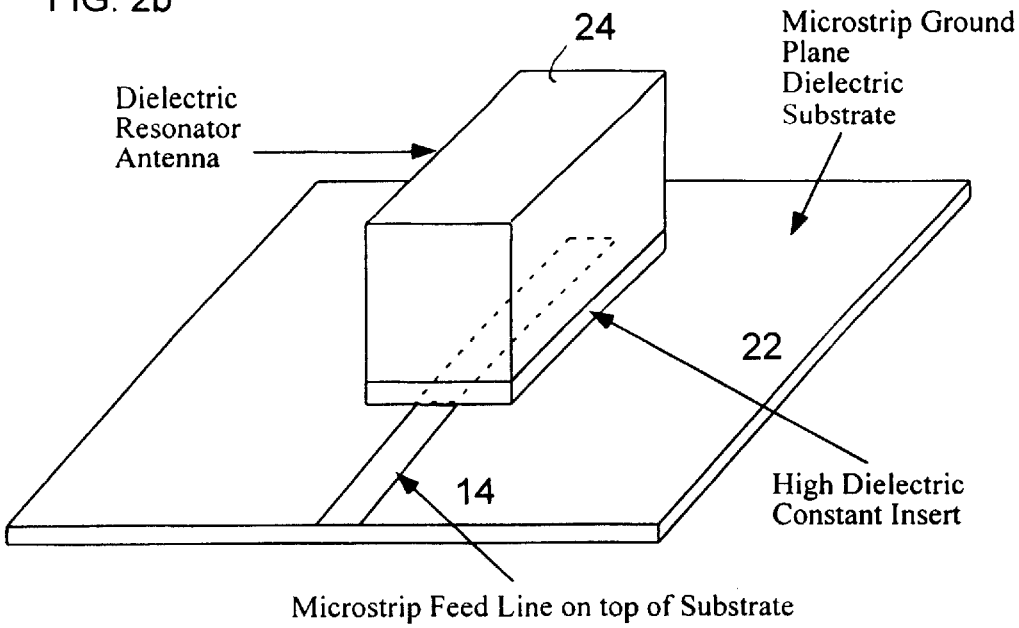
FIG. 2*b* is an illustration of a solid dielectric resonator antenna with high dielectric insert fed by a microstrip line.
Figure 2D:
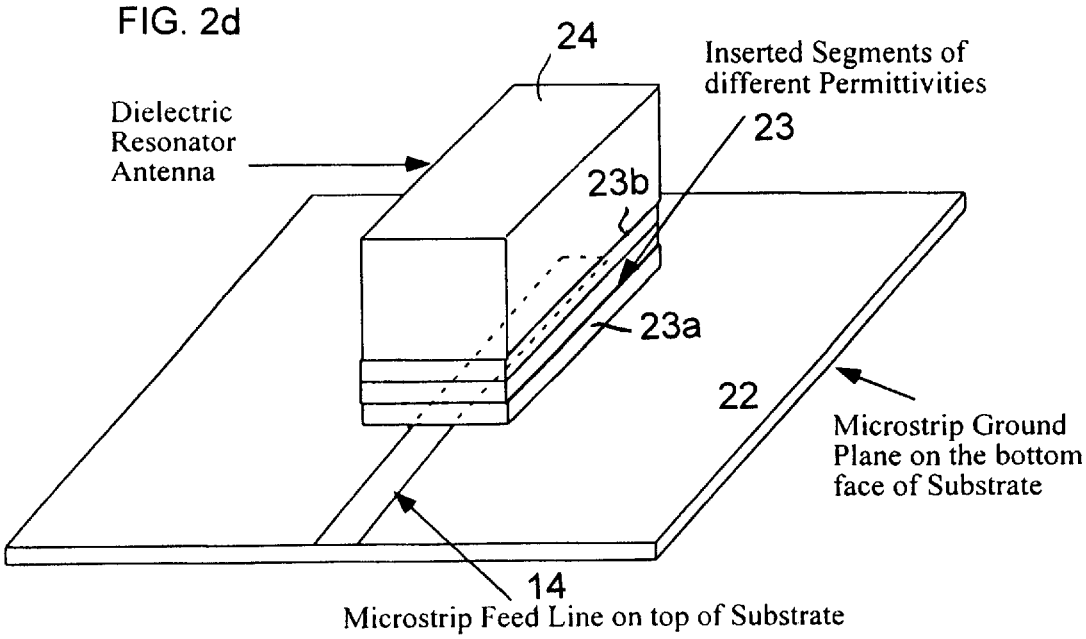
FIG. 2*d* is an illustration similar to that of FIG. 2*d* having inserted segments of different permittivities including a high dielectric constant.

In operation, the antenna behaves like a short magnetic dipole aligned along the axis of the slot 16 with the maximum radiation in the boresight direction. In instances where the efficiency of coupling is low, the coupling efficiency can be improved by increasing the magnetic field intensity around the slot through the use of a thin strip 23 of high dielectric constant shown in FIG. 2*a*. In FIG. 2*a* a high dielectric constant insert 23 placed over the slot 16 in the central portion of a rectangular DRA 24 thereby being disposed between the feed means and the dielectric resonator, is first coupled thus creating a strong magnetic field in its vicinity. This in turn strongly excites the required mode of the rectangular DRA 24. It is preferable that the high dielectric constant substrate 22 or insert 23 has a dielectric value of at least twice that of the DRA 24, and in a preferred embodiment, the value of the dielectric constant of the substrate 22 (as shown in FIG. 2*b*), or insert 23, is 4 times that of the DRA 24. The dimension of the thin high dielectric constant strip 23 is experimentally optimized. The dielectric strip is much thinner than the DRA so that the major contribution to the radiation is from the DRA. Preferably the thickness of the dielectric substrate 22 is less than $\lambda/10$. The high dielectric strip can also be used to enhance the coupling to the DRA from a microstrip line 14 as well as a slot 16, as shown in FIG. 2*b*. FIG. 2*c* shown an embodiment similar to that of FIG. 2*a*, wherein a high dielectric insert material 23 fills the entire notched portion or cavity defined within the DRA. Also, the DRA need not have a notch, rectangular or otherwise, in order for the high dielectric constant insert to enhance the coupling. In FIGS. 2*b* and 2*d*, the dielectric resonator antenna is shown having a microstrip ground plane on the bottom face of a substrate having a microstrip feed line on top of the substrate. The high dielectric insert layer 23 is disposed between the microstrip ground plane and the solid DRA. The embodiment shown in FIG. 2*d* includes a plurality of layers 23*a* and 23*b* of different permittivities.

Experimental Results

Several notched DRAs of different $L_1/L_2$ ratios were fabricated from RT/Duroid 6010 with dielectric constant of 10.8. At present, the theory to determine the resonant frequency for this DRA structure is not yet known. Thus, their dimensions were determined using the theory of a solid rectangular DRA. From perturbation theory, it was expected that the resonant frequency of the notched DRA would be slightly higher than the solid rectangular DRA. This was confirmed by the measured results. It should be noted that the operating frequency in this study was arbitrarily chosen for the convenience of the measurement. In the following experiment, the slot dimensions and the matching stub length L3 (shown in FIG. 1*b*) were optimized so that one of the samples had a good match to the feed line. This same slot was then used to feed the other samples so that the effects of $L_1/L_2$ could be studied.

The measured return loss of notched DRAs having different ratios of $L_1/L_2$ is shown in FIG. 3. The results show the characteristic of a double tuned resonant circuit. The ratio $L_1/L_2$ can be used to control the location of the upper and the lower resonating frequencies, which increase with $L_1/L_2$. When the two frequencies are located closer to each other, the antenna has a broad operating bandwidth. When the two frequencies are farther apart, the antenna can be utilized in a dual band mode of operation. For the samples studied, it is found that the bandwidth of the notched DRA can be increased to 28% as compared to 10% for its solid counterpart. The measured radiation patterns of this antenna varied only slightly over this broad impedance bandwidth, (as shown in FIG. 4). Hence, it is clear that the operating bandwidth of this notched dielectric antenna is 28%, which is a significant improvement over its solid counterpart and the single microstrip patch element (a few per cent bandwidth). It should be noted that the cross-polarization level of this antenna is 20 dB lower than the peak co-polarization level over the same frequency band.

The DRAs above when redesigned for the operation at half of the original operating frequencies, were fabricated from material with a dielectric constant of 10. The feed line was constructed from the same substrate as in the previous cases. Using the above design it was found that it was not possible to achieve the efficient coupling without making the slot size too big. This is not a desirable solution due to increasing radiation loss from the slot.

In accordance with this invention, by introducing a material with a high dielectric constant, in the form of an insert (FIG. 2*a*), the coupling efficiency was significantly increased without increasing the radiation loss from the slot. The achieved operational bandwidth was found to be 30%.

Tests were also carried out using the configuration shown in FIG. 2*b*, where a solid DRA was placed on top of a microstrip line. Using a DRA of dielectric constant 10, there was only a limited amount of coupling when the DRA was placed on a open-ended 50 Ω microstrip line, achieving a maximum of 5 dB return loss. When a thin dielectric insert (dielectric constant of 40) was added (FIG. 2*b*), the amount of coupling increased substantially, achieving a maximum return loss of 24 dB and a 10 dB return loss bandwidth of 16% as shown in FIG. 5. Thus there is significant improvement in using a thin dielectric insert having a high dielectric constant between the feed line and the dielectric resonator.

In another embodiment of the invention, a high gain, low profile active phased array antenna is provided with electronic beam steering capability in the azimuth plane. The radiating elements comprise the multi-segment dielectric resonator antennas described heretofore optionally and preferably, of rectangular cross-section, and fed by a microstrip line. Providing the thin dielectric insert 22 having a high dielectric constant, between the feed line and the dielectric resonators enhances the operation of the DRAs.

The array combines DRA technology with multi-layer printed technology and offers high gain, wide pattern bandwidths, and electronic beam steering capability.

Figure 6A:
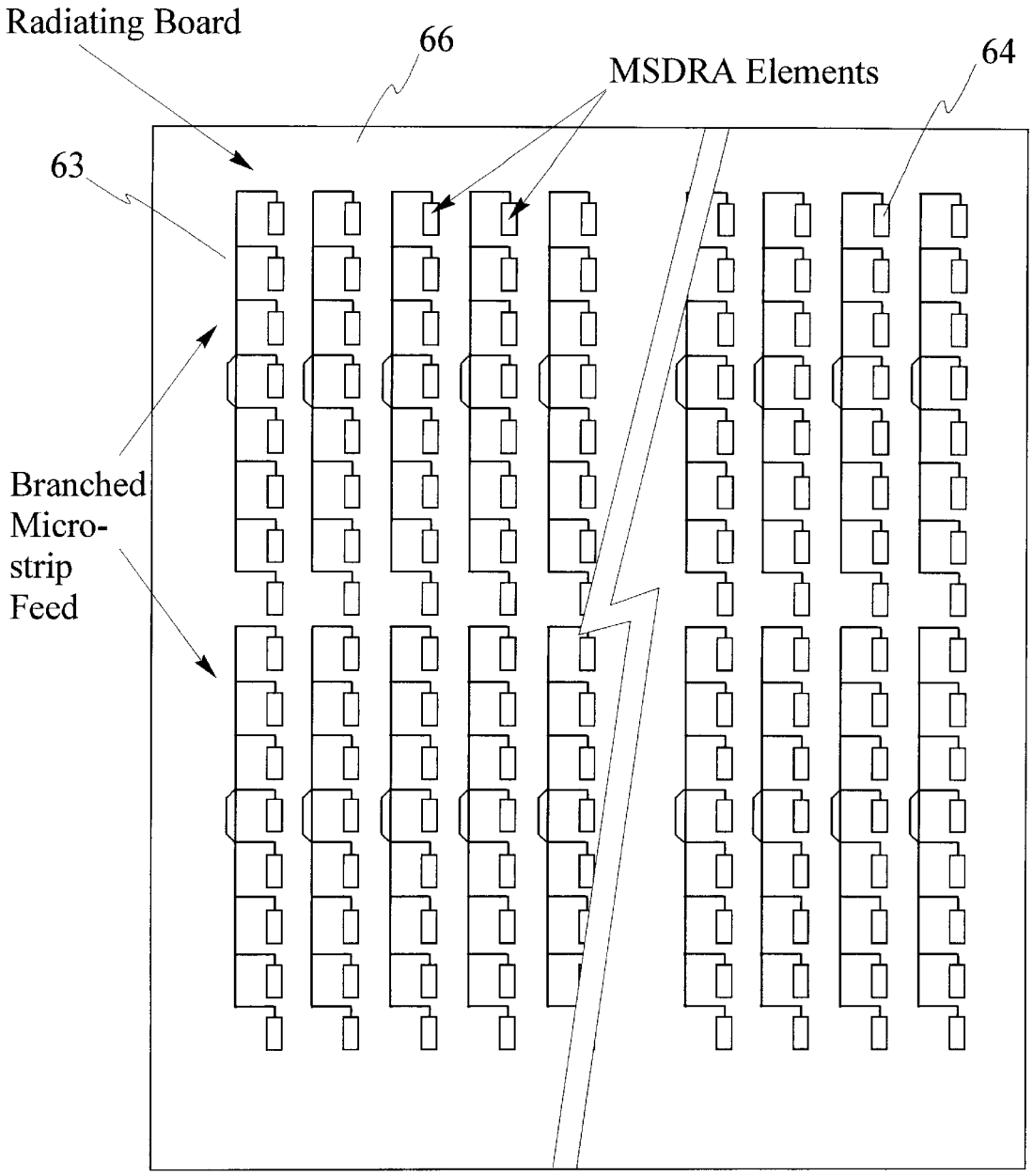
FIG. 6*a* is a diagram in top view depicting the geometry of an active phased array dielectric antenna in accordance with the invention.
Figure 6B:
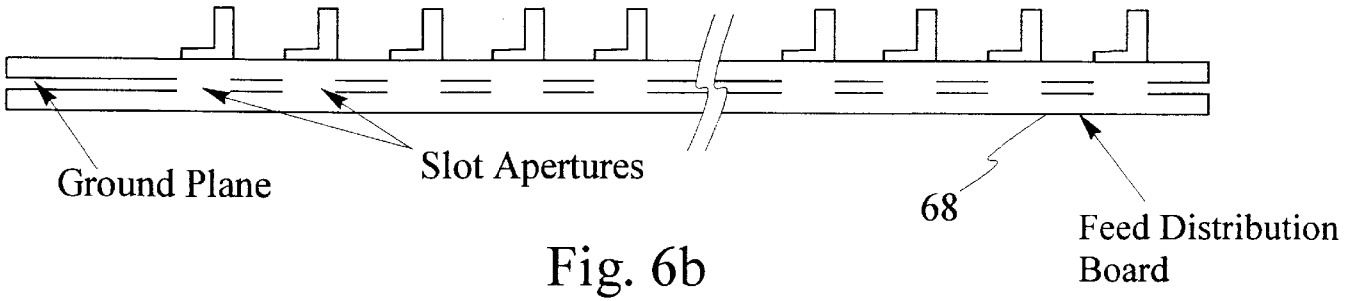
FIG. 6*b* is diagram in side view of the active phase array antenna shown in FIG. 6*b;*
Figure 7A:
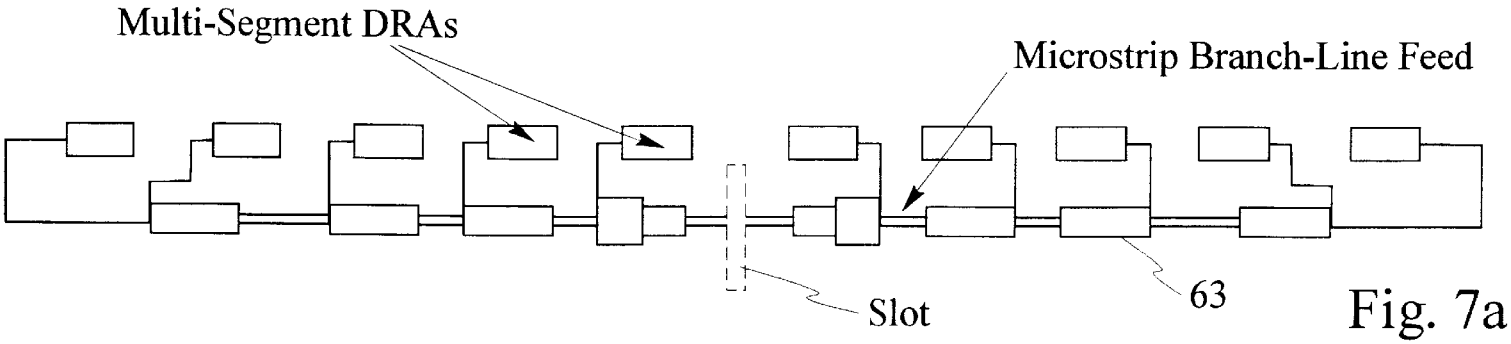
FIG. 7*a* is a top view of a column sub-array of multi-segment DRAs fed by a multi-layer microstrip network.
Figure 7B:
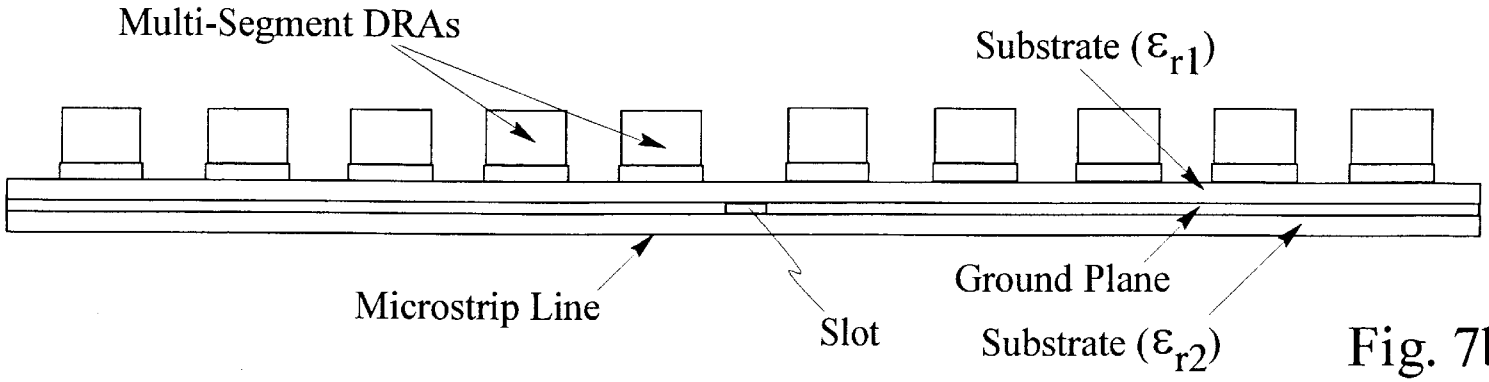
FIG. 7*b* is a side view of the column sub-array of DRAs shown in FIG. 7*a;*

Diagrams of the geometry of the array are shown in FIGS. 6*a* and 6*b*. The array has a multi-layer architecture having a radiating board 66, and feed distribution board 68. The radiating antenna includes 16 linear column arrays of multi-segment DRA elements 64. Each linear column comprises two collinear sub-arrays formed of branched microstrip lines 63 feeding 10 DRA elements; the 10-element sub-array is shown in FIGS. 7*a* and 7*b*. These branched lines are in turn fed by aperture coupling to the power distribution network, located on a second layer beneath the radiating board. The power distribution network includes a printed corporate feed, incorporating phase shifters for electronic beam steering in the azimuth plane. Low noise amplifiers (LNAs) are also integrated into each column to reduce the adverse effects of transmission line loss with respect to noise temperature.

Several prototype arrays have been fabricated and tested. The first array to be fabricated was a passive antenna containing 64 elements. The next iteration, which has recently been completed and tested, was an active antenna containing 320 DRAs and 16 integrated LNAs (15 dB gain stage). The measured patterns are shown in FIGS. 8 and 9 while the boresight gain versus normalized frequency is shown in FIG. 10. A peak active gain (antenna gain including LNAs) of 39 dBi was measured with a 3 dB gain bandwidth of 15%. Good cross-polarization was also achieved, with levels on the order of 20 dB below the peak co-polarized gain on boresight.

Of course, numerous other embodiments may be envisaged without departing from the spirit and scope of the invention.

What is claimed is:

1. A dielectric resonator antenna system comprising:

a) a grounded substrate;

b) a dielectric resonator having a dielectric constant k disposed a predetermined distance from the grounded substrate;

c) feed means for transferring energy into and from said dielectric resonator; and, d) a thin dielectric substrate having a thickness of less than approximately λ/10 and, having a dielectric constant of approximately 2k or greater, the thin dielectric substrate being disposed between the feed means and the dielectric resonator for enhancing coupling therebetween.

2. A dielectric resonator antenna system as defined in claim 1, wherein the feed means comprises a microstrip line.

3. A dielectric resonator antenna system as defined in claim 1, wherein the dielectric resonator includes an opening in the form of a cavity.

4. The dielectric resonator antenna system as defined in claim 1 including a slot within the ground plane for accommodating said feed means.

5. The dielectric resonator antenna system as defined in claim 3, including a slot within the ground plane for accommodating the feed means.

6. The dielectric resonator antenna system as defined in claim 5, wherein the cavity is rectangular.

7. A dielectric resonator antenna system comprising a plurality of resonator antenna elements each comprising:

a) a grounded substrate;

b) a dielectric resonator having a dielectric constant k disposed a predetermined distance from the grounded substrate;

c) feed means for transferring energy into and from said dielectric resonator; and, d) a thin dielectric substrate having a thickness of less than λ/10 and, having a dielectric constant of approximately 2 k or greater, the thin dielectric substrate being disposed between the feed means and the dielectric resonator for enhancing coupling therebetween.

8. A radiating antenna system as defined in claim 7, wherein the plurality of resonator antenna elements have a common grounded substrate.

9. A radiating antenna system as defined in claim 1 wherein the thin dielectric substrate has a thickness of approximately λ/30 or less.

10. A radiating antenna system as defined in claim 1 wherein the dielectric constant of the thin dielectric substrate is approximately 4k or greater.

11. A dielectric resonator antenna system comprising:

a) a grounded substrate;

b) a dielectric resonator having a dielectric constant k disposed a predetermined distance from the grounded substrate;

c) feed means for transferring energy into and from said dielectric resonator; and, d) a first dielectric material having a dielectric constant of approximately 2k or greater being substantially non-resonant at a resonance of the first dielectric resonator, said first dielectric material being disposed between the feed means and the dielectric resonator for enhancing coupling therebetween.

12. A dielectric resonator antenna system as defined in claim 11 wherein the dielectric resonator includes an opening in the form of a resonant cavity.

13. The dielectric resonator antenna system as defined in claim 11 including a slot within the ground plane for accommodating said feed means.

14. The dielectric resonator antenna system as defined in claim 12, including a slot within the ground plane for accommodating the feed means.

15. The dielectric resonator antenna system as defined in claim 14, wherein the cavity is rectangular.

16. The dielectric resonator antenna system as defined in claim 12, wherein the dielectric material having a dielectric constant of approximately 2k or greater is in the form of an insert disposed within the resonant cavity.

17. The dielectric resonator antenna system as defined in claim 16 wherein the insert is a rectangular block of material.

18. A radiating antenna system as defined in claim 8, wherein the feed means comprises a microstrip line.

19. A dielectric resonator antenna system comprising an array of antenna elements, each element comprising:

a) a grounded substrate;

b) a dielectric resonator having a dielectric constant k disposed a predetermined distance from the grounded substrate;

c) feed means for transferring energy into and from said dielectric resonator; and, d) a dielectric material having a dielectric constant of approximately 2k or greater being substantially non-resonant at a resonance of the first dielectric resonator, said first dielectric material being disposed between the feed means and the dielectric resonator for enhancing coupling therebetween.

20. A dielectric resonator antenna system as defined in claim 8, wherein the grounded substrate is common to a plurality of the elements and including a slot within the grounded substrate.

21. A dielectric resonator antenna system as defined in claim 8, wherein the feed means comprises a microstrip branched feed line for feeding a plurality of the dielectric resonators.

* * * * *